US012611056B2

(12) United States Patent
Hofmann et al.

(10) Patent No.: US 12,611,056 B2
(45) Date of Patent: Apr. 28, 2026

(54) CONVERTIBLE BLANKET WITH STORAGE SACK

(71) Applicant: DICK'S Sporting Goods, Inc., Coraopolis, PA (US)

(72) Inventors: Craig Francis Hofmann, Pittsburgh, PA (US); Matthew Marchand, Pittsburgh, PA (US)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 723 days.

(21) Appl. No.: 18/062,686

(22) Filed: Dec. 7, 2022

(65) Prior Publication Data

US 2024/0188735 A1 Jun. 13, 2024

(51) Int. Cl.

| | |
|---|---|
| ***A47G 9/02*** | (2006.01) |
| ***A45C 9/00*** | (2006.01) |
| ***A45C 13/10*** | (2006.01) |

(52) U.S. Cl.

CPC ..... *A47G 9/0223* (2013.01); *A45C 9/00* (2013.01); *A45C 13/1046* (2013.01)

(58) Field of Classification Search

CPC ..... A47G 9/062; A47G 9/0223; A47G 9/064; A47G 9/0207; A47G 9/066; A47G 9/06; A47G 9/02; A47G 9/08; A45F 4/02; A45F 4/12; A45F 2004/003; A41D 2400/422; A41D 15/04; A41D 3/08; A41D 7/008; A41D 1/215; A41D 2300/30; A41D 2300/33; A45C 13/1046; A45C 9/00; A47B 7/00; A41B 2300/30; A41B 2300/33

(Continued)

(56) References Cited

U.S. PATENT DOCUMENTS 1,895,911 A * 1/1933 Bosson, Jr. ..... A45F 4/14 2/84

2,462,780 A 2/1949 Schiller (Continued)

FOREIGN PATENT DOCUMENTS

CA 2804561 A1 * 8/2013 ..... A41B 13/06

KR 200459497 Y1 * 4/2012 ..... A42B 1/041

(Continued)

OTHER PUBLICATIONS

KR-200459497-Y1—English Translation (Year: 2012).*

KR-101177079-B1—English Translation (Year: 2012).*

NPL Search (Year: 2025).*

*Primary Examiner* — Eric J Kurilla

*Assistant Examiner* — Amanda L Bailey

(74) *Attorney, Agent, or Firm* — Foley & Lardner LLP

(57) ABSTRACT

A blanket includes a pocket comprising a cavity positioned between a first outer layer and the second outer layer of a body of the blanket. The pocket has a receiving edge that coincides with a portion of the first outer layer, a portion of the second outer layer, or both. The blanket also includes a sack that includes an opening having a perimeter, at least a portion of which is attached to at least a portion of the receiving edge of the pocket. When the blanket is in a wearable configuration, the sack is contained within the pocket. When the blanket is in a storage configuration, the body is at least substantially contained within the sack. Methods of converting the blanket between the wearable configuration and the storage configuration are also disclosed.

20 Claims, 5 Drawing Sheets

(58) Field of Classification Search
USPC ..... 5/485; D6/603
See application file for complete search history.

(56) References Cited

U.S. PATENT DOCUMENTS

| | | | | |
|---|---|---|---|---|
| 2,791,775 | A * | 5/1957 | Sartell | A41D 15/04 2/69.5 |
| 2,898,609 | A | 8/1959 | Storie | |
| 3,633,227 | A | 1/1972 | Tegeler | |
| 4,231,125 | A | 11/1980 | Tittl | |
| 4,466,516 | A | 8/1984 | Sicoli et al. | |
| 4,634,618 | A * | 1/1987 | Greer | A47G 9/062 428/126 |
| 4,789,247 | A | 12/1988 | Schnoor | |
| 4,951,333 | A | 8/1990 | Kaiser et al. | |
| 5,414,881 | A * | 5/1995 | Terrazas | A47G 9/064 2/202 |
| 5,421,045 | A * | 6/1995 | Bowen | A47G 9/1045 446/73 |
| D360,797 | S | 8/1995 | Evans | |
| 5,443,880 | A | 8/1995 | Wike | |
| 5,463,783 | A | 11/1995 | Pope | |
| 5,737,785 | A | 4/1998 | Casey | |
| 6,192,536 | B1 * | 2/2001 | Connors | A47G 9/062 5/419 |
| 6,393,638 | B1 * | 5/2002 | MacColl | B60N 2/60 5/419 |
| 6,647,570 | B1 | 11/2003 | Ong | |
| 6,952,845 | B1 | 10/2005 | Akkad | |
| 7,111,343 | B1 | 9/2006 | Bates | |
| D551,891 | S * | 10/2007 | Kaiser | D6/595 |
| 7,779,492 | B2 | 8/2010 | Mangano | |
| 7,900,303 | B2 * | 3/2011 | Mastrosimone-Gese | A47D 13/083 5/639 |
| 8,464,374 | B1 | 6/2013 | Thayer | |
| D693,987 | S | 11/2013 | Wagner et al. | |
| D834,352 | S | 11/2018 | Oyekan | |
| D862,118 | S | 10/2019 | Rogers et al. | |
| D862,119 | S | 10/2019 | Rogers et al. | |
| D878,109 | S | 3/2020 | Rogers et al. | |
| 10,959,549 | B2 | 3/2021 | Rogers et al. | |
| D923,258 | S | 6/2021 | Chen | |
| D925,840 | S | 7/2021 | Chen | |
| 2004/0199998 | A1 | 10/2004 | Shinner | |
| 2005/0039261 | A1 | 2/2005 | Corral | |
| 2005/0262634 | A1 | 12/2005 | Gottlieb | |
| 2010/0078458 | A1 * | 4/2010 | Mottram | A47G 9/086 224/576 |
| 2014/0023295 | A1 | 1/2014 | Wagner | |
| 2014/0109287 | A1 * | 4/2014 | Ramirez | A42B 1/04 2/84 |
| 2015/0143632 | A1 | 5/2015 | Obrentz | |
| 2015/0164249 | A1 | 6/2015 | Scott et al. | |
| 2016/0007774 | A1 * | 1/2016 | Kakabeeke | A47G 9/0246 5/496 |
| 2019/0246712 | A1 * | 8/2019 | Sonksen | A47G 9/064 |
| 2021/0177169 | A1 | 6/2021 | Rogers et al. | |
| 2021/0284393 | A1 * | 9/2021 | Page | A45C 3/00 |
| 2022/0175161 | A1 * | 6/2022 | MacLaurin | A47G 9/086 |

FOREIGN PATENT DOCUMENTS

| | | | | |
|---|---|---|---|---|
| KR | 101177079 | B1 * | 8/2012 | |
| WO | WO-0187125 | A1 * | 11/2001 | A47G 9/086 |

* cited by examiner

CONVERTIBLE BLANKET WITH STORAGE SACK

BACKGROUND

For outdoor recreation activities such as camping, blankets can be helpful for use as a warm layer on a chilly day or to provide ground cover, such as for a picnic or stargazing activity. However, campers and other outdoor recreation enthusiasts usually try to pack as lightly and as efficiently as possible. Accordingly, articles that have versatility, pack compactly, and that allow the user to have their hands free are needed.

SUMMARY

At least some of the problems associated with the existing solutions will be shown solved by the subject matter of the independent claims that are included in this document. Additional advantageous aspects are discussed in the dependent claims.

In some embodiments, this disclosure describes a blanket comprising a body that includes a first outer layer and a second outer layer. The blanket also includes a pocket comprising a cavity positioned between the first outer layer and the second outer layer. The pocket has a receiving edge that coincides with a portion of the first outer layer, a portion of the second outer layer, or both. The blanket also includes a sack that includes an opening having a perimeter, at least a portion of which is attached to at least a portion of the receiving edge of the pocket. When the blanket is in a wearable configuration, the sack is contained within the pocket. When the blanket is in a storage configuration, the body is at least substantially contained within the sack.

Optionally, the blanket also may include a closure device attached to the sack near the opening. When the blanket is in the wearable configuration, the closure device is substantially contained in the sack and the opening is relatively larger. When the blanket is in the storage configuration, the closure device is substantially extended from the sack and the opening is relatively smaller. Optionally, the closure device may include a drawstring. Optionally, a fastener may be attached to the closure device and capable of securing the closure device in an extended position when the blanket is in the storage configuration. The body may further comprise a passageway that is positioned to receive the fastener when the blanket is in the wearable configuration. The passageway that receives the fastener may be formed of a first opening in the first outer layer and a second opening in the second outer layer.

In any of the embodiments above, the body of the blanket may further comprise an insulation layer that is positioned between the first outer layer and the second outer layer. The insulation layer comprises a notch that provides an area for the cavity, and segments of the first outer layer and the second outer layer serve as walls of the pocket. Alternatively, a segment of the insulation layer serves as a first wall of the pocket, a segment of either the first outer layer or the second outer layer serves as a second wall of the pocket, and the cavity may be positioned between the first wall and the second wall.

In any of the embodiments above, a gusset may surround the opening of the sack.

In other embodiments, a method of converting a blanket from a wearable configuration to a storage configuration are disclosed. The method includes holding a blanket that comprises: (a) a body including a first outer layer and a second outer layer; (b) a pocket comprising a cavity positioned between the first outer layer and the second outer layer, the pocket having a receiving edge that coincides with a portion of the first outer layer, a portion of the second outer layer, or both; and (c) a sack that includes an opening having a perimeter, at least a portion of which is attached to at least a portion of the receiving edge of the pocket. The method also includes withdrawing the sack from the pocket, and then compressing the body into the sack.

Optionally, the method may further comprise extending a drawstring of the sack and securing the drawstring with a fastener to hold the opening of the sack in a closed position.

DETAILED DESCRIPTION

Disclosed is a blanket that can be converted to a storage configuration in which a portion of the blanket can be contained in an integrally formed sack. In addition to the storage configuration, the blanket can also be converted to a wearable configuration in which a user can fasten the blanket around their body and wear. Therefore, the blanket may provide certain advantages over other types of blankets, for example: because it is compactable, it may be easily stored and transported; and because it is wearable, it can serve as outerwear.

Figure 1A:
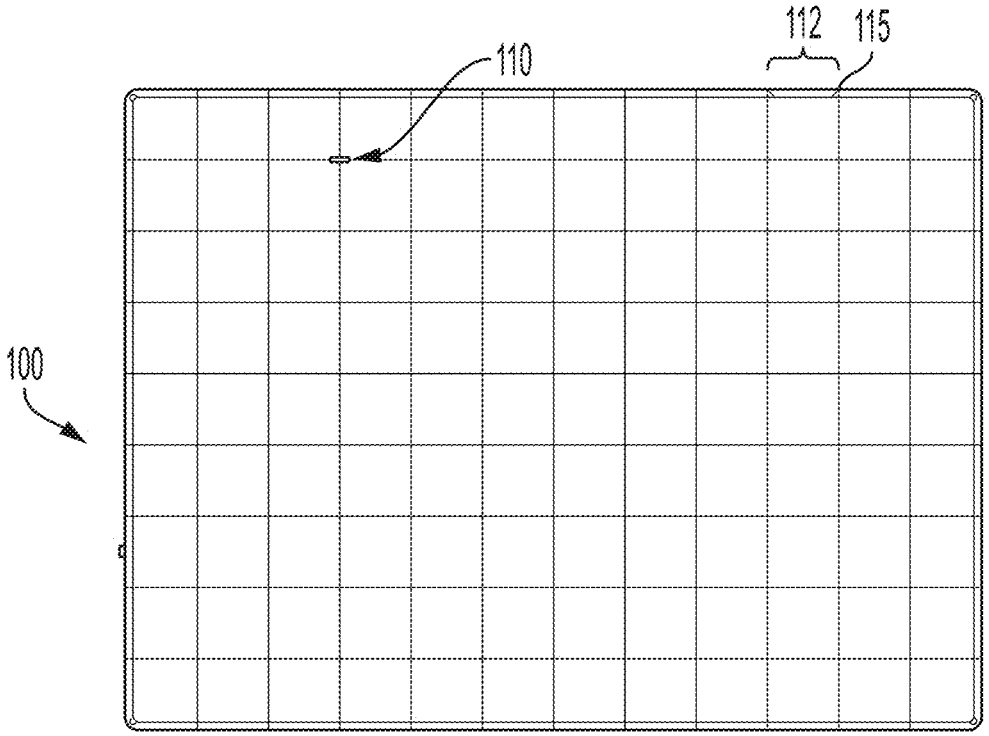
FIG. 1A illustrates an example blanket according to an embodiment.
Figure 1B:
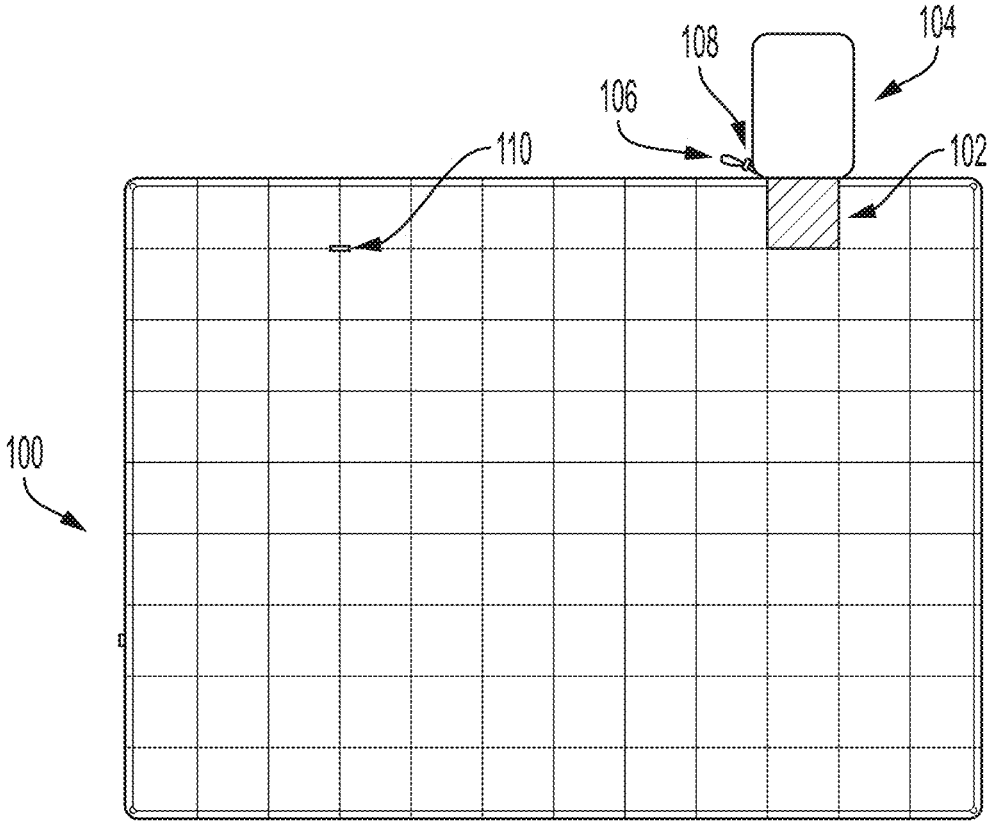
FIG. 1B illustrates the blanket of FIG. 1A, with a pocket along with a sack that has been withdrawn from the pocket.

Referring now to FIGS. 1A and 1B, an example embodiment of a blanket 100 is shown. The blanket 100 as shown has a rectangular shape, but in alternative embodiments it could have any shape, such as oval, square, or the shape of any polygon.

Figure 2:
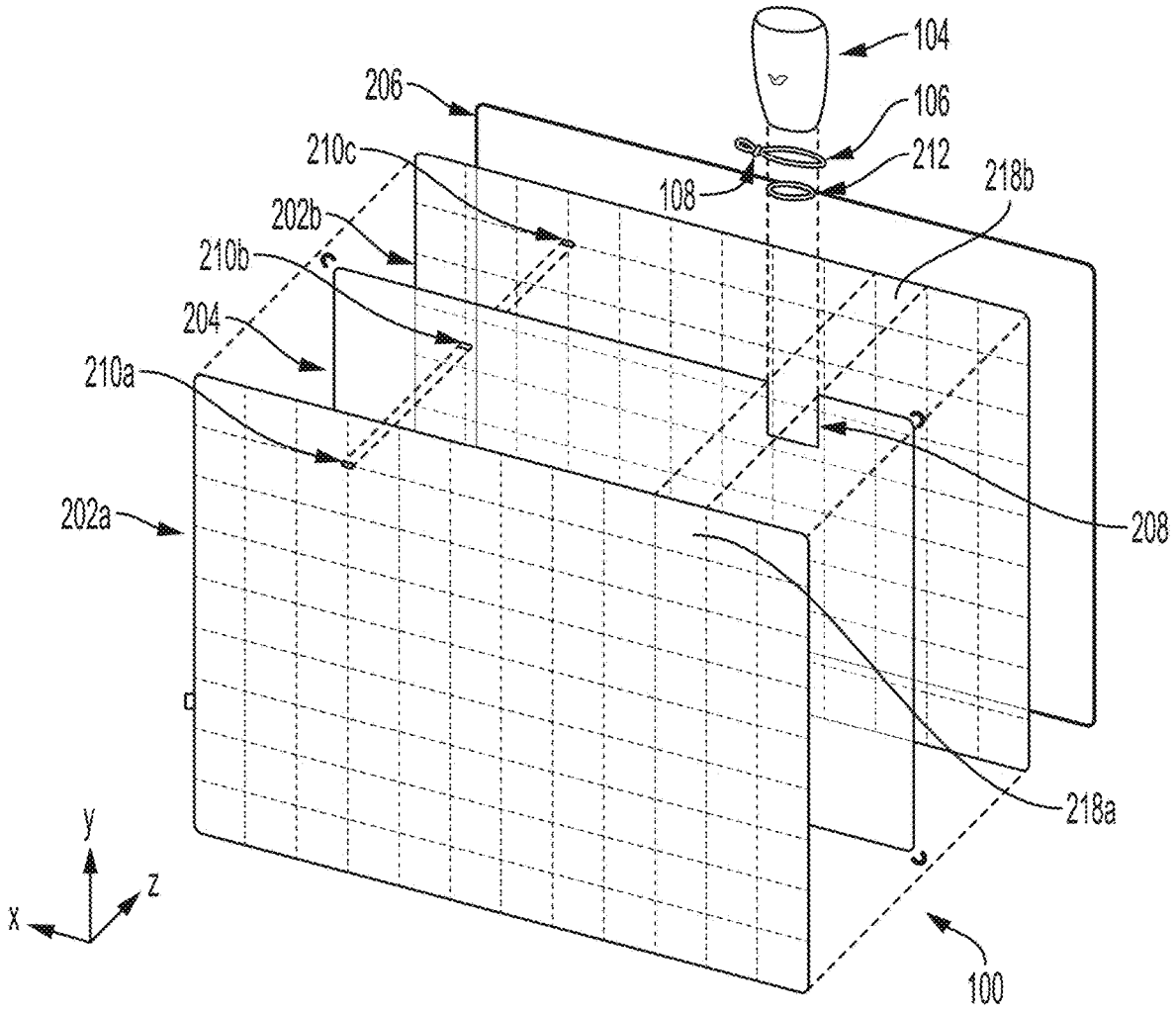
FIG. 2 illustrates an exploded view of the example blanket of FIG. 1A including the sack of FIG. 1B.

FIG. 2 is an exploded view of the blanket 100. FIG. 2 also includes a three-dimensional coordinate system for reference. As shown, the blanket 100 includes a body that is made of two outer layers 202*a* and 202*b*. As shown, the body of the blanket 100 includes at least one insulation layer 204. The outer layers 202*a* and 202*b* and (when included) the insulation layer 204 are held together by binding 206 that is stitched, adhered, or otherwise connected to both outer layers, or by stitching or another material or structure that fastens the outer layer to the inner layer. In some embodiments, the body of the blanket 100 can include one or more additional insulation layers to make the blanket warmer, while in other embodiments the blanket may have no insulation layer and simply may be formed of the outer layers. The outer layers 202*a* and 202*b* may be made of any fabric such as a cotton, polyester, nylon, microfiber, or blended material. The insulation layer(s) 204 may be made of any suitable insulating material, including but not limited to foam, down, or a cotton, polyester, wool and/or silk fill material.

Returning to FIGS. 1A and 1B, the blanket 100 includes a pocket 102 into which a sack 104 can fit. In FIG. 1A, the sack 104 is tucked into the pocket and thus not visible. The pocket 102 has a receiving edge 112, which coincides at least in part with an outer edge of the blanket 100 and forms an opening 115. In FIG. 1B, the sack 104 is extended from the pocket 102. Although in practice the pocket may not be visually identifiable on the outer layers of the blanket, in FIG. 1B the location of the pocket 102 within the blanket is depicted using diagonal lines to emphasize its position relative to the sack 104. In practice, the outside portion of the pocket 102 can be of the same material, or a material of a similar color, that gives it a visual appearance that is similar to that of the portion of the blanket 100 that surrounds the pocket, as in the illustration of FIG. 1A in which the pocket is not emphasized using cross-hatching. Alternatively, the location of the pocket may be visually apparent based on the use of different materials, or colors, or location markings.

The sack 104 includes an open end and a closed end. At least a portion of a perimeter 119 of the opening end of the sack 104 is coincident with the receiving edge of the pocket. Thus, opening 115 of the pocket 102 is formed at least in part by the intersection of the open end of the sack 104 and the receiving edge of the pocket 102. In this way, the sack 104 may be placed within the pocket 102 as in FIG. 1A or extended from the pocket as in FIG. 1B. When the sack 104 is extended from the pocket 102, the body of the blanket may be compressed into the sack as will be described below. In addition, when the sack 104 is extended from the pocket 102, and to the extent that space permits with the sack 104 is in the pocket 102, the pocket 102 may be used to hold other items, such as one or more keys, cards such as financial transaction cards or identification cards, or other small items.

Figure 3:
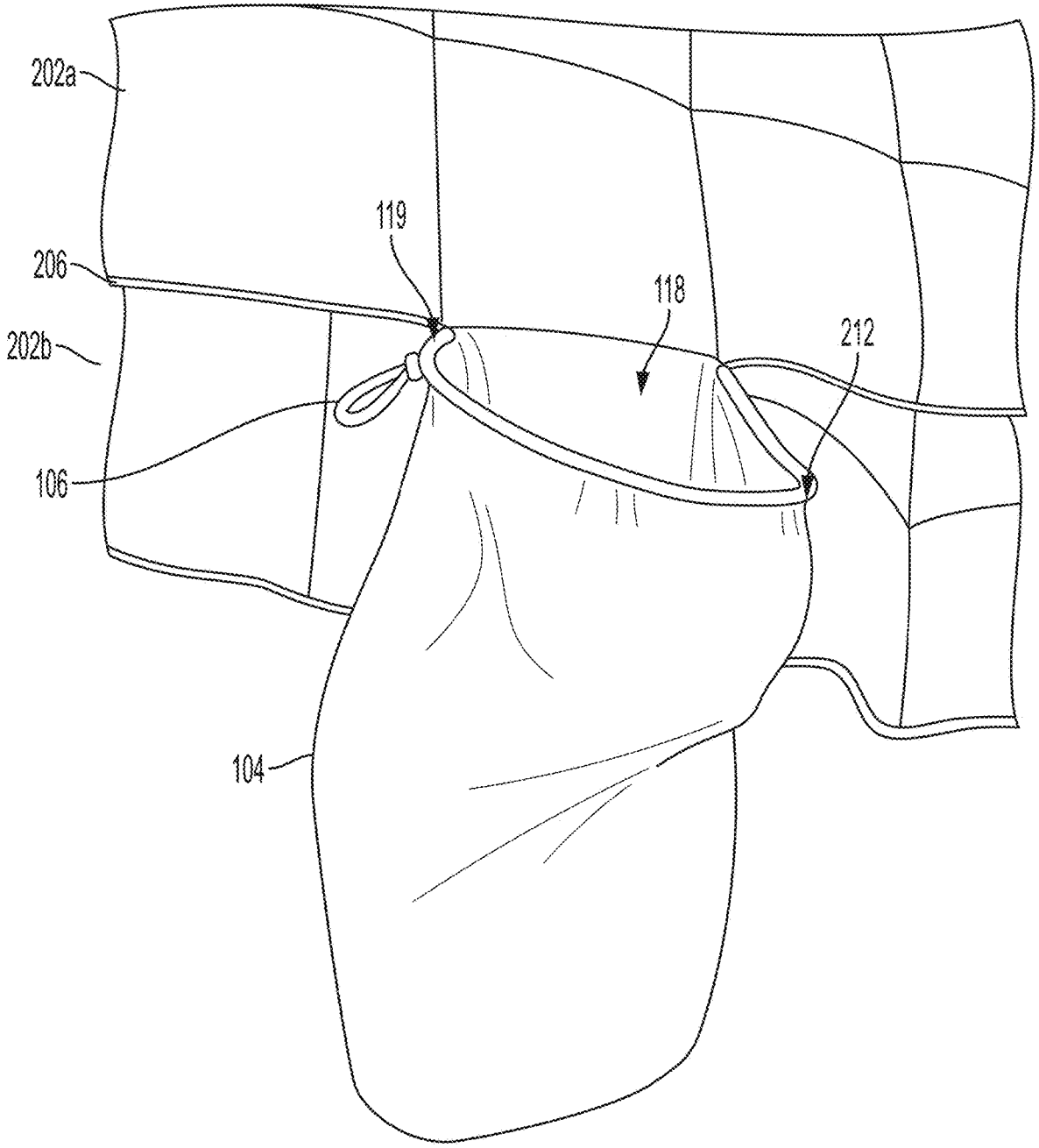
FIG. 3 illustrates a perspective view of the blanket, with the sack withdrawn from the pocket.

FIG. 3 provides a perspective view of a configuration in which the sack 104 is extended from the pocket. In FIG. 3, the blanket is folded so that the first outer layer 202*a* faces upward in the upper part of the image and the second outer layer 202*b* faces upward in the lower part of the image. The sack's opening 118 is shown, and it includes a segment that is attached to the body of the blanket at or near the binding 206. The body of the blanket (i.e., the parts formed by outer layers 202*a* and 202*b*, along with any intermediate insulating layers) may be compressed into the sack through the opening 118.

Referring to FIGS. 1A and 2-4, a closure device such as a drawstring 106 is connected to the sack 104 at the open end of the sack. The drawstring 106 can be connected to the sack 104 using any method such that the drawstring can be drawn, such as by being strung through a casing, thereby causing the opening of the open end to shrink when the drawstring is pulled from the casing. The drawstring 106 includes a free portion that extends from the sack 104 and a portion that encircles the open end of the sack 104 within the casing. The portion of the drawstring 106 that encircles the open end of the sack also may pass through or be located substantially adjacent to a portion of the sack referred to in this document as a cinch gusset, or simply gusset 212, which is shown in FIGS. 2 and 3 and discussed below.

Referring to FIGS. 1B and 3, the blanket 100 further includes a fastener 108 which is attached to the drawstring 106. The position of the fastener 108 can be adjusted along the free portion of the drawstring 106. The fastener 108 can be any fastener capable of clamping the drawstring 106 such that the position of the fastener along the drawstring is locked in place until adjusted by a user. For example, the fastener 108 can be a cord lock that includes a spring, which may also be referred to as a cord fastener, cord toggle, spring clasp, or stopper. When the drawstring 106 is pulled out of the casing, the fastener 108 may secure the drawstring 106 and thus narrow the diameter of the opening 115 to be smaller than the diameter of the filled sack 104. When the fastener 108 is released, the gusset may expand and draw more of the drawstring 106 into the casing, thus expanding the size of the opening 115 and allowing a user to withdraw the body of the blanket from the sack 104.

Referring again to FIG. 2, the exploded view of the blanket 100 includes the sack 104, the drawstring 106, and the fastener 108. As described above, the pocket can enclose the sack 104 in a wearable configuration, while the sack 104 may enclose the body of the blanket in a storage configuration. The walls of the pocket may be formed at least in part by the outer layers 202*a* and 202*b*. In the example of FIG. 2, the pocket is formed by connecting (e.g., stitching or gluing) segments 218*a* and 218*b* of the outer layers 202*a* and 202*b* together in the shape of a "U" as seen in the x-y plane. A notch 208 of the insulation layer 204 is provided to allow a U-shaped connection between the outer layers 202*a* and 202*b*, as well as to provide a space that serves as the cavity of the pocket. In some embodiments, instead of forming walls of the pocket from segments 218*a* and 218*b* of both of the outer layers 202*a* and 202*b*, a pocket can be connected to one of the outer layers 202*a* or 202*b* and the insulation layer 204, in which case the insulation layer would not have a notch but instead would serve as a first wall of the pocket, and one of the outer layers would serve as an opposite second wall of the pocket. The location and shape of the pocket as described here are by way of example; the pocket may be positioned in other locations or have other shapes in various embodiments.

Referring to FIGS. 1A through 4, in some embodiments the blanket 100 may include a passageway 110 through which the drawstring 106 and the fastener 108 can pass when the blanket is in one of multiple alternative configurations: a wearable configuration and a storage configuration. In embodiments where the blanket 100 includes the passageway 110 described above, the outer layers 202*a* and 202*b* and the insulation layer 204 may include openings 210*a*, 210*b*, and 210*c*, respectively, which are positioned to overlap with each other and provide the complete passageway 110 which is a passage through the entire body. The openings 210*a*, 210*b*, and 210*c* are sized to allow the drawstring 106 and the fastener 108 to pass through them. The fastener 108 may have cylindrical, rectangular, or otherwise sized to have a first dimension that fits through the passageway 110 and a second dimension that is larger than the opening, to inhibit the fastener 108 from returning through the passageway 110 after the fastener 108 has passed through the passageway 110.

The drawstring 106 can pass through the openings 210*a*, 210*b*, and 210*c*, when the blanket 100 is in the wearable configuration. When instead the blanket 100 is in the storage configuration, the drawstring 106 can be drawn to at least narrow, and in some embodiments close, the opening 118 of the sack 104. (This document will use the term "closed" to refer to a situation in which the diameter of the opening is either closed or just partially reduced as compared to its relaxed position.) To allow the sack 104 to be closed, the sack includes a gusset 212, which surrounds the opening 118 of the sack. The gusset 212 is shaped such that when the drawstring 106 is drawn, the open end of the sack 104 is closed. For example, the gusset 212 may be a loop of fabric having an interior space that extends around the loop. The interior space can be sized such that a portion of the drawstring 106 can fit into it. By drawing the drawstring 106, the loop of the gusset 212 and the open end of the sack 104 to which it is connected may shrink. The fabric loop of the gusset 212 can be attached along the outer edge of the receiving end of the sack 104, on the outside of the receiving end of the sack, or on the inside of the receiving end of the sack.

The blanket 100 can be made from a variety of materials chosen to provide comfort, warmth, and durability. For example, referring again to FIG. 2, the outer layers 202*a* and 202*b* can be made of materials that are warm and waterproof or water-resistant, such as nylon, polyester, and polycotton. One of the outer layers may be formed of a relatively rugged material such as a polyester with a polyurethane or other coating that provides a durable water-repellent (DWR) finish, while the other layer may be formed of a relatively comfortable or soft material such as a polyester/rayon blend with a fiber filling. Similar materials can be chosen for the sack 104 and the gusset 212. The binding 206 can be any material that can durably bind the outer layers 202*a* and 202*b* and the insulation layer 204, such as a thin rope, a silk cloth, and/or other material. The insulation layer 204 can include synthetic or natural insulation. For example, synthetic insulation can include synthetic fibers, while natural insulation can include down feathers, such as goose down. The drawstring 106 can be made from a natural or synthetic rope material.

Figure 4:
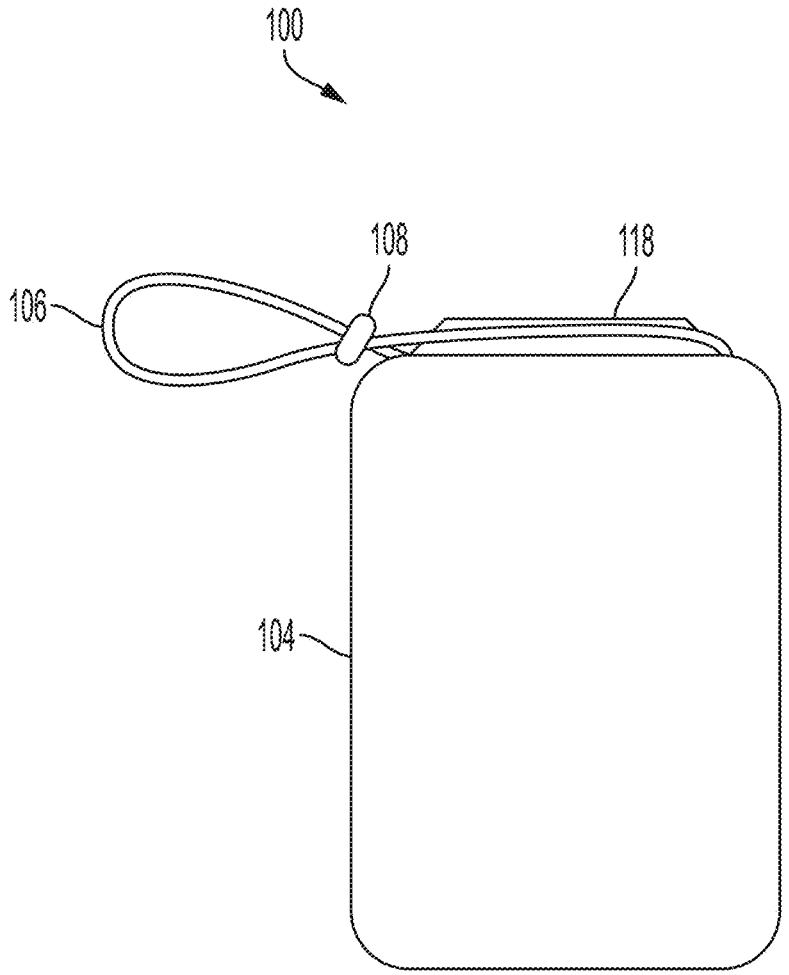
FIG. 4 illustrates a storage configuration of the example blanket.

FIG. 4 shows the blanket 100 in a storage configuration, in which the layers and (if present) insulation of at least a portion of the blanket body are compressed and contained within the sack 104. When the blanket 100 is in the storage configuration shown in FIG. 4, it takes up less space than it does when it is being used as a blanket in the wearable configuration.

In the illustration of FIG. 3, most of the body of the blanket 100 is enclosed by the sack 104, and the drawstring 106 is drawn to reduce the size of the opening 118 of the sack. Furthermore, by adjusting the fastener 108 along the free portion of the drawstring 106, it is possible to secure the blanket in the storage configuration.

Figure 5:
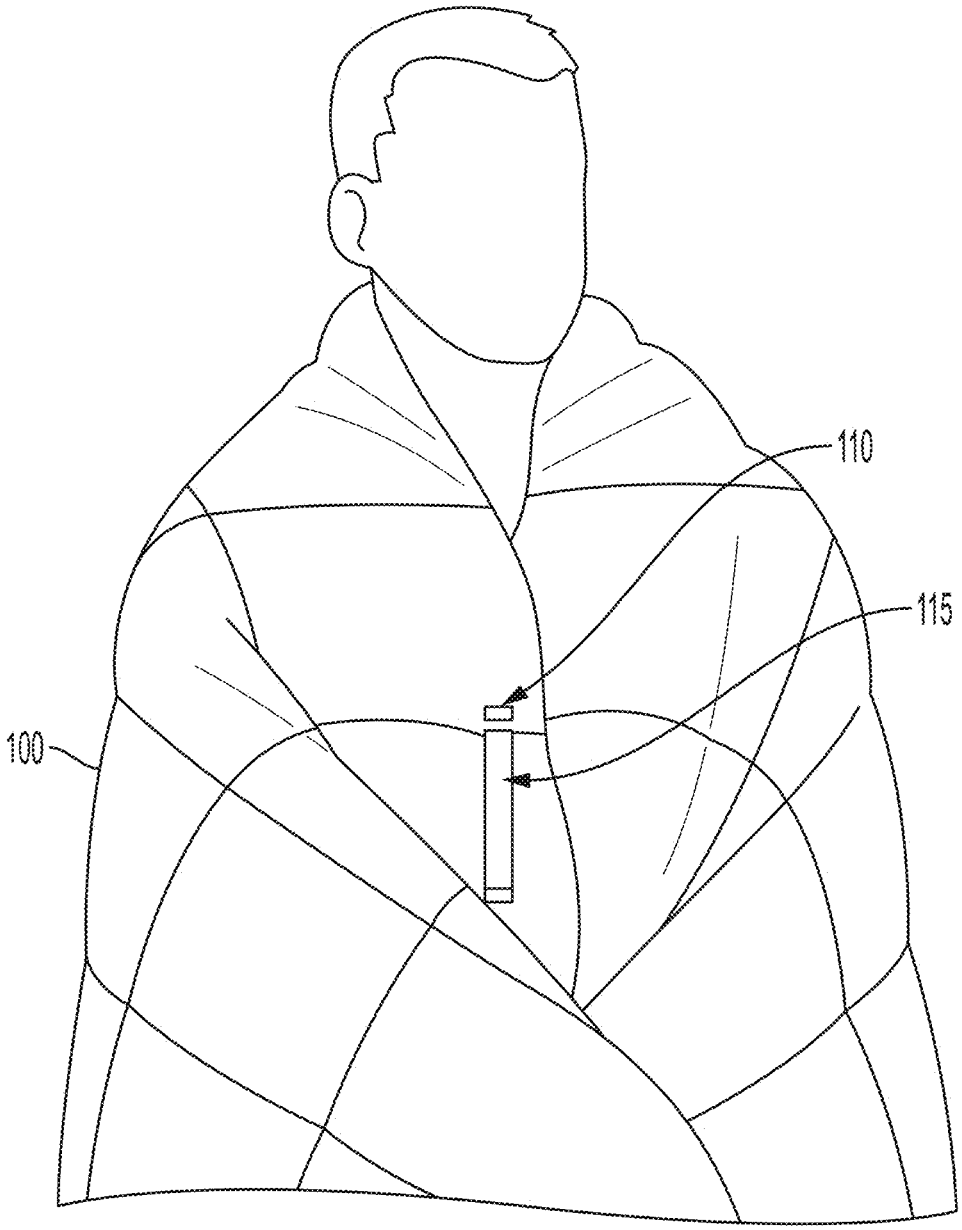
FIG. 5 illustrates a wearable configuration of the example blanket.

In addition to being maintained in the storage configuration of FIG. 4, the blanket 100 can also be converted into a wearable configuration. This is shown in FIG. 5. In the wearable configuration of FIG. 5, the blanket 100 can be worn by a user, for example, draped over a wearer's shoulders. The sack can be tucked into the pocket through opening 115 when the blanket 100 is in the wearable configuration, e.g., to obscure the presence of the sack. The sack is not shown in FIG. 5 because it is necessarily obscured in this configuration. The drawstring 106 and the fastener 108 can be inserted into the passageway 110 to keep the blanket from slipping off the wearer's body. (Note that in FIG. 5, the relative positions of passageway 110 and opening 115 on the blanket 100 are different than those shown in FIGS. 1A, 1B, and 2.)

Thus, as shown above, the blanket 100 is alternatively configurable between different configurations, including a storage configuration and a wearable configuration. In the storage configuration (as shown in FIG. 4), most of the body of the blanket (including the outer layers) will be contained within the sack 104, typically in a compressed state to reduce storage space requirements. In the wearable configuration (as shown in FIG. 5), the body of the blanket is not compressed within the sack 104, but instead the sack 104 is contained within the pocket 102, and the blanket can be used just like any blanket, such as being pulled over the body by a user to keep warm.

For the purposes of the above detailed description, it is to be understood that this disclosure may assume various alternative variations and step sequences, except where expressly specified to the contrary. Moreover, other than in any operating examples, or where otherwise indicated, all numbers expressing, for example, sizes or a material's characteristics used in the specification and claims are to be understood as being modified in all instances by the term "about". Accordingly, unless indicated to the contrary, the numerical parameters set forth in this specification and attached claims are approximations that may vary depending upon the desired properties to be obtained. At the very least, and not as an attempt to limit the application of the doctrine of equivalents to the scope of the claims, each numerical parameter should at least be construed in light of the number of reported significant digits and by applying ordinary rounding techniques.

In this application, the use of the singular includes the plural, and plural encompasses singular, unless specifically stated otherwise. As used in this document, the singular forms "a," "an," and "the" include plural references unless the context clearly dictates otherwise. For example, "a" layer and the like refer to one or more of any of these items. Unless defined otherwise, all technical and scientific terms used herein have the same meanings as commonly understood by one of ordinary skill in the art.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In addition, in this application, the use of "or" means "and/or" unless specifically stated otherwise, even though "and/or" may be explicitly used in certain instances.

As used herein, the transitional term "comprising" (and other comparable terms, e.g., "containing" and "including") is "open-ended" and open to the inclusion of unspecified matter. Although described in terms of "comprising", the terms "consisting essentially of" and "consisting of" are also within the scope of this document.

In this document, when terms such as "first" and "second" are used to modify a noun, such use is simply intended to distinguish one item from another and is not intended to require a sequential order unless specifically stated. Likewise, references to a "first" layer and a "second" layer do not mean that the disclosure or claims are limited to embodiments having only two layers; any number of intermediate or other layers may be included unless otherwise specified.

In this document, when terms such as "first" and "second" are used to modify a noun, such use is simply intended to distinguish one item from another, and is not intended to require a sequential order unless specifically stated.

In this document, the term "connected", when referring to two physical structures, means that the two physical structures at least partially touch each other. Devices that are connected may be secured to each other, or they may simply touch each other and not be secured.

The invention claimed is:

1. A blanket comprising:

a body including:

a first outer layer, and a second outer layer, the first outer layer and the second outer layer defining a passageway;

a pocket positioned within the body between the first outer layer and the second outer layer, the pocket comprising a cavity, the pocket having a receiving edge that coincides with at least one of a portion of the first outer layer or a portion of the second outer layer;

a sack that includes an opening having a perimeter, at least a portion of which is attached to at least a portion of the receiving edge of the pocket; and a closure device that extends around the opening of the sack and comprises a fastener, wherein:

the sack is contained within the pocket when the blanket is in a wearable configuration, the fastener is configured to be positioned through the passageway to secure the blanket in the wearable configuration, the body is at least substantially contained within the sack when the blanket is in a storage configuration, and the fastener is configured to secure the opening of the sack in a closed position when in the storage configuration.

2. The blanket of claim 1, wherein:

when the blanket is in the wearable configuration, the closure device is substantially contained in the sack and the opening is a first size; and when the blanket is in the storage configuration, the closure device is substantially extended from the sack and the opening is a second size that is smaller than the first size.

3. The blanket of claim 2, wherein the closure device comprises a drawstring.

4. The blanket of claim 1, wherein the fastener is capable of securing the closure device in an extended position when the blanket is in the storage configuration.

5. The blanket of claim 1, wherein the passageway comprises:

a first opening in the first outer layer; and a second opening in the second outer layer.

6. The blanket of claim 1, wherein the body further comprises an insulation layer that is positioned between the first outer layer and the second outer layer.

7. The blanket of claim 6, wherein:

the insulation layer comprises a notch that provides an area for the cavity; and segments of the first outer layer and the second outer layer serve as walls of the pocket.

8. The blanket of claim 6, wherein:

a segment of the insulation layer serves as a first wall of the pocket;

a segment of either the first outer layer or the second outer layer serves as a second wall of the pocket; and the cavity is positioned between the first wall and the second wall.

9. The blanket of claim 1, further comprising a gusset that surrounds the opening of the sack.

10. A blanket comprising:

a body including:

a first outer layer, and a second outer layer, the first outer layer and the second outer layer defining a passageway;

a pocket positioned within the body between the first outer layer and the second outer layer, the pocket comprising a cavity, the pocket having a receiving edge that coincides with at least one of a portion of the first outer layer or a portion of the second outer layer;

an insulation layer that is positioned between the first outer layer and the second outer layer;

a sack that includes an opening having a perimeter, at least a portion of which is attached to at least a portion of the receiving edge of the pocket; and a closure device attached to the sack near the opening and extends around the opening, the closure device comprising a fastener, wherein:

the sack is contained within the pocket, the closure device is substantially contained in the sack, and the opening is a first size when the blanket is in a wearable configuration, the fastener is configured to be positioned through the passageway to secure the blanket in the wearable configuration, the body is at least substantially contained within the sack, the closure device is substantially extended from the sack, and the opening is a second size that is smaller than the first size when the blanket is in a storage configuration, and the fastener is configured to secure the opening of the sack in a closed position when in the storage configuration.

11. The blanket of claim 10, wherein:

the insulation layer comprises a notch that provides an area for the cavity; and segments of the first outer layer and the second outer layer serve as walls of the pocket.

12. The blanket of claim 10, wherein:

a segment of the insulation layer serves as a first wall of the pocket;

a segment of either the first outer layer or the second outer layer serves as a second wall of the pocket; and the cavity is positioned between the first wall and the second wall.

13. The blanket of claim 10, wherein the closure device comprises a drawstring.

14. The blanket of claim 13, further comprising a fastener that is attached to the drawstring and capable of securing the drawstring in an extended position when the blanket is in the storage configuration.

15. The blanket of claim 10, wherein the passageway comprises:

a first opening in the first outer layer; and a second opening in the second outer layer.

16. The blanket of claim 10, further comprising a gusset that surrounds the opening of the sack.

17. A method of converting a blanket from a wearable configuration to a storage configuration, the method comprising:

holding a blanket that comprises:

a body including a first outer layer and a second outer layer defining a passageway, a pocket positioned within the body between the first outer layer and the second outer layer, the pocket comprising a cavity, the pocket having a receiving edge that coincides with at least one of a portion of the first outer layer or a portion of the second outer layer;

a sack that includes an opening having a perimeter, at least a portion of which is attached to at least a portion of the receiving edge of the pocket, and a closure device that extends around the opening of the sack and comprises a fastener;

releasing the fastener from the passageway;

withdrawing the sack from the pocket;

compressing the body into the sack; and adjusting the fastener to secure the opening of the sack in a closed position.

18. The method of claim 17, further comprising extending a drawstring of the sack and securing the drawstring with a fastener to hold the opening in a closed position.

19. A blanket comprising:

a body including:

a first outer layer, a second outer layer, and a passageway comprising a first opening in the first outer layer and a second opening in the second outer layer;

a pocket comprising a cavity positioned between the first outer layer and the second outer layer, the pocket having a receiving edge that coincides with a portion of the first outer layer, a portion of the second outer layer, or both;

a sack that includes an opening having a perimeter, at least a portion of which is attached to at least a portion of the receiving edge of the pocket;

a closure device attached to the sack near the opening; and a fastener that is attached to the closure device and capable of securing the closure device in an extended position when the blanket is in a storage configuration, wherein the passageway is positioned to receive the fastener when the blanket is in a wearable configuration, wherein when the blanket is in a wearable configuration:

the sack is contained within the pocket, and the closure device is substantially contained in the sack and the opening is a first size, and wherein when the blanket is in a storage configuration:

the body is at least substantially contained within the sack, the closure device is substantially extended from the sack, and the opening is a second size that is smaller than the first size.

20. A blanket comprising:

a body including:

a first outer layer, a second outer layer, and a passageway comprising a first opening in the first outer layer and a second opening in the second outer layer;

a pocket comprising a cavity positioned between the first outer layer and the second outer layer, the pocket having a receiving edge that coincides with a portion of the first outer layer, a portion of the second outer layer, or both;

an insulation layer that is positioned between the first outer layer and the second outer layer;

a sack that includes an opening having a perimeter, at least a portion of which is attached to at least a portion of the receiving edge of the pocket;

a closure device attached to the sack near the opening and comprising a drawstring; and a fastener that is attached to the drawstring and capable of securing the drawstring in an extended position when the blanket is in a storage configuration, wherein:

the passageway is positioned to receive the fastener when the blanket is in a wearable configuration, the sack is contained within the pocket, the closure device is substantially contained in the sack, and the opening is a first size when the blanket is in the wearable configuration, and the body is at least substantially contained within the sack, the closure device is substantially extended from the sack, and the opening is a second size that is smaller than the first size when the blanket is in a storage configuration.

* * * * *